US007614516B2

(12) United States Patent
Beggins

(10) Patent No.: US 7,614,516 B2
(45) Date of Patent: Nov. 10, 2009

(54) COMBINATION BOTTLE AND CAN COOLER

(75) Inventor: Thomas M. Beggins, San Juan Capistrano, CA (US)

(73) Assignee: Wallis H. Wallis Trust of 2004, San Juan Capistrano, CA (US)

( * ) Notice: Subject to any disclaimer, the term of this patent is extended or adjusted under 35 U.S.C. 154(b) by 0 days.

(21) Appl. No.: 11/742,418

(22) Filed: Apr. 30, 2007

(65) Prior Publication Data

US 2007/0199935 A1 Aug. 30, 2007

Related U.S. Application Data

(63) Continuation-in-part of application No. 10/791,087, filed on Mar. 2, 2004, now Pat. No. 7,201,285.

(51) Int. Cl.
*B65D 23/08* (2006.01)

(52) U.S. Cl. ..... 215/386; 215/393; 220/8; 220/592.24; 220/737; 220/903

(58) Field of Classification Search ..... 215/386, 215/10, 13, 1, 393; 220/737, 739, 903, 675, 220/8, 492.15–592.17, 592.24
See application file for complete search history.

(56) References Cited

U.S. PATENT DOCUMENTS

| | | | | |
|---|---|---|---|---|
| 930,219 | A | 8/1909 | Paalen | |
| 995,700 | A | 6/1911 | Maynard | |
| 1,744,498 | A | 1/1930 | Payson et al. | |
| 1,927,553 | A * | 9/1933 | Lusher | 222/183 |
| 1,999,670 | A | 4/1935 | Strouse et al. | |
| 2,115,654 | A | 4/1938 | Swofford | |
| 2,556,893 | A | 6/1951 | Zwiebach et al. | |
| 2,576,725 | A | 11/1951 | Schoelles | |
| 2,773,358 | A | 12/1956 | Palmer et al. | |
| 2,805,556 | A | 9/1957 | Wang | |
| 2,889,065 | A | 6/1959 | Lawlor | |
| 3,076,575 | A * | 2/1963 | Laurance | 215/12.1 |
| 3,090,478 | A | 5/1963 | Stanley | |
| 3,105,592 | A * | 10/1963 | Cohen | 206/0.8 |
| 3,120,319 | A | 2/1964 | Buddrus | |
| 3,155,260 | A | 11/1964 | Widener | |
| 3,229,840 | A | 1/1966 | Filleul | |
| 3,302,428 | A | 2/1967 | Stoner et al. | |
| 3,494,499 | A | 2/1970 | Plot et al. | |
| 3,553,976 | A | 1/1971 | Cumine et al. | |
| 3,613,761 | A | 10/1971 | Moody | |
| 3,627,161 | A | 12/1971 | Wergeland | |
| 3,779,298 | A | 12/1973 | Piccirilli et al. | |

(Continued)

FOREIGN PATENT DOCUMENTS

| | | |
|---|---|---|
| CA | 1251744 | 3/1989 |

(Continued)

*Primary Examiner*—Sue A Weaver

(57) ABSTRACT

An insulating holder for holding a beverage in a bottle or a can having a lower cylindrical enclosure which receives an upper cylindrical enclosure. The lower cylindrical enclosure has vertical ribs to frictionally grip the upper cylindrical enclosure. The upper cylindrical enclosure is adapted to cover the top portion of a bottle inserted into the lower cylindrical enclosure and to snuggly receive a can when inverted and inserted into the lower cylindrical enclosure.

3 Claims, 5 Drawing Sheets

U.S. PATENT DOCUMENTS 3,901,228 A 8/1975 Brown
3,910,328 A 10/1975 Marcoux
3,918,920 A 11/1975 Barber
3,979,011 A 9/1976 Schleicher
3,987,643 A 10/1976 Willis
3,998,072 A 12/1976 Shaw
4,071,031 A 1/1978 Lowman
4,114,759 A 9/1978 Maloney, Jr.
4,240,272 A 12/1980 Tiede et al.
4,281,520 A 8/1981 Norwood
4,300,612 A 11/1981 Schroeder, Jr. et al.
4,456,134 A 6/1984 Cooper
4,487,327 A 12/1984 Grayson
4,510,769 A 4/1985 McClellan, Jr.
4,534,391 A * 8/1985 Ventimiglia et al. ..... 220/739
4,577,474 A * 3/1986 Peterson ..... 62/457.4
4,708,254 A 11/1987 Byrns
4,811,858 A 3/1989 Augur
4,823,974 A 4/1989 Crosser
4,823,975 A 4/1989 Schwankl
4,870,837 A * 10/1989 Weins ..... 62/457.4
5,134,739 A 8/1992 Gaffe et al.
5,375,898 A 12/1994 Ohmori et al.
5,390,804 A 2/1995 Beggins
5,580,343 A 12/1996 Cafiero
5,605,242 A * 2/1997 Hwang ..... 220/8
5,829,591 A 11/1998 Lyons
5,904,267 A 5/1999 Thompson
6,123,220 A 9/2000 Williams
6,311,865 B1 11/2001 Laurent
6,398,061 B2 6/2002 Duff et al.
6,460,722 B2 * 10/2002 Lee ..... 220/592.16
6,484,897 B1 11/2002 Crawley
6,554,155 B1 4/2003 Beggins
6,604,649 B1 8/2003 Campi
7,201,285 B2 * 4/2007 Beggins ..... 215/386

FOREIGN PATENT DOCUMENTS

DE 2616502 10/1977
DE 3417061 11/1985
DE 3534103 4/1987
EP 0182690 5/1986
FR 846816 9/1939
FR 1013815 8/1952
GB 21585 9/1911
GB 990011 4/1965
GB 2240332 7/1991

* cited by examiner

COMBINATION BOTTLE AND CAN COOLER

This application is a continuation-in-part of U.S. application Ser. No. 10/791,087 filed Mar. 2, 2004, now U.S. Pat. No. 7,201,285, entitled DUAL FUNCTION INSULATING HOLDER FOR BOTTLE OR CAN.

BACKGROUND OF THE INVENTION

1. Field of the Invention

The present invention relates to improvements in holders for maintaining cold containerized liquids in a cool state and more particularly pertains to a new and improved lightweight portable holder for either a bottle or a can.

2. Description of Related Art

A number of structures for insulating containers have been proposed in the prior art. Perhaps the most familiar structure is the cylindrical foam jacket or sleeve conventionally used to cool standard cylindrical cans containing beer, soda and the like. Such devices are typically inadequate and only partially effective when it comes to a bottle. Other structures exhibit practical drawbacks in that they leave the bottle contents partially exposed or employ cumbersome attachment mechanisms such as mechanical clasps or snaps.

Applicant's U.S. Pat. No. 5,390,804 discloses a bottle insulating device having a lower cylindrical enclosure which telescopically receives an upper cylindrical enclosure having a dome-shaped upper end and an opening therein of a diameter selected to determine the extent to which the upper cylindrical enclosure slides down the bottle neck and, hence, the extent to which the upper cylindrical enclosure extends into the lower cylindrical enclosure.

Applicant's U.S. Pat. No. 6,554,155 discloses an insulating device for bottles having a lower cylindrical enclosure which telescopically receives an upper cylindrical enclosure having a dome-shaped upper end, the upper and lower cylindrical enclosures being provided with mating threads adapted to achieve a plunge insertion and sealing feature.

While these structures exhibit advantages over other prior art cooler devices, it has become apparent to applicant that further improvements could provide even a more useful and effective cooler apparatus, especially in the provision of a single apparatus that can accommodate both a bottle and a can which can easily be used.

SUMMARY OF THE INVENTION

An insulating holder having a lower cylindrical enclosure receives an upper cylindrical enclosure which has a dome-shaped upper end. The upper and lower cylindrical enclosures fit together by the upper cylindrical enclosure sliding into the lower cylindrical enclosure. The lower cylindrical enclosure has a plurality of ribs integral with the interior wall of the lower cylindrical enclosure to aid in frictionally gripping the upper cylindrical enclosure when the upper cylindrical enclosure is slid into the lower cylindrical enclosure. Each rib can have a uniform protrusion along the vertical axis of the lower cylindrical enclosure or the protrusion can be gradually tapered vertically such that rib has a smaller protrusion near the top of the lower cylindrical enclosure and a larger protrusion near the bottom of the lower cylindrical enclosure. When the upper cylindrical enclosure is inserted into the lower cylindrical enclosure with the dome-shaped upper end on top, the insulating holder accommodates a variety of different sizes of beverage bottles. When the upper cylindrical enclosure is inserted into the lower cylindrical enclosure with the dome-shaped end, the insulating holder accommodates a variety of different sized beverage cans inserted into the upper cylindrical enclosure.

BRIEF DESCRIPTION OF THE DRAWINGS

The exact nature of this invention, as well as the objects and advantages thereof, will become readily apparent from consideration of the following specification in conjunction with the accompanying drawings in which like reference numerals designate like parts throughout the figures thereof and wherein.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
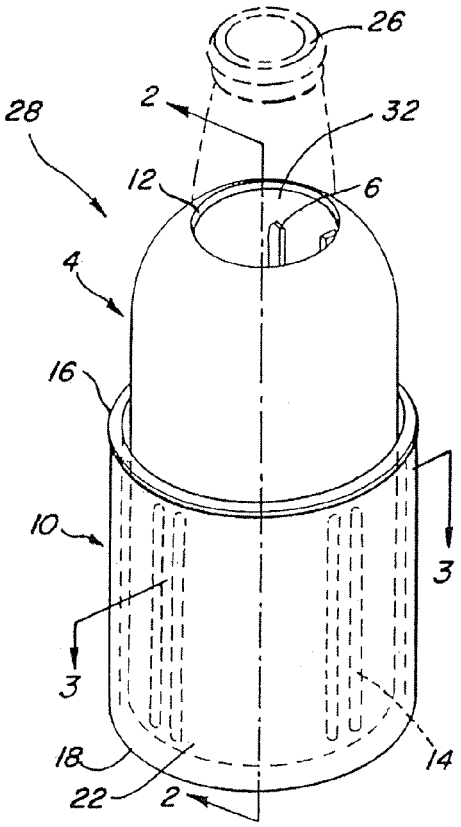
FIG. 1 is a perspective view of a preferred embodiment of the invention.

FIG. 1 illustrates an insulating holder 28 of a first preferred embodiment, which includes a lower cylindrical enclosure 10 and an upper cylindrical enclosure 4. Both the upper cylindrical enclosure 4 and the lower cylindrical enclosure 10 are preferably formed out of a relatively rigid insulating material such as, for example, Styrofoam, which provides structural integrity as well as insulating properties. Both the upper cylindrical enclosure 4 and lower cylindrical enclosure 10 are shown installed about a bottle 26 (in phantom). The bottle 26 is generally formed to have a side and a neck, in which the neck generally increases in diameter from the top capped part to a shoulder area (not shown).

To hold the bottle 26, the lower cylindrical enclosure 10 can have a depth sized to receive at least one-fourth of the length of the bottle 26. The general construction of the upper and lower cylindrical enclosures 4 and 10, respectively, are more completely described in applicant's U.S. Pat. Nos. 5,390,804 and 6,554,155, the disclosures of which are both incorporated herein by reference.

The upper cylindrical enclosure 4 has a dome-shaped first end 30, a second circular rim end 22, a circular opening 12, an interior wall 32, and a plurality of shims 6 located on the interior wall 32. It is inserted into the lower cylindrical enclosure 10. The lower cylindrical enclosure 4 comprises a top portion 16 and a bottom portion 18. Lower cylindrical enclosure 4 also has a plurality of vertical ribs 14 on an interior wall 24 (not shown) of the lower cylindrical enclosure 4 to frictionally grip the upper cylindrical enclosure 4. While FIG. 1 depicts a plurality of vertical ribs 14, it is contemplated, however, that utilizing only one vertical rib may be sufficient to frictionally grip the upper cylindrical enclosure 4.

Figure 2:
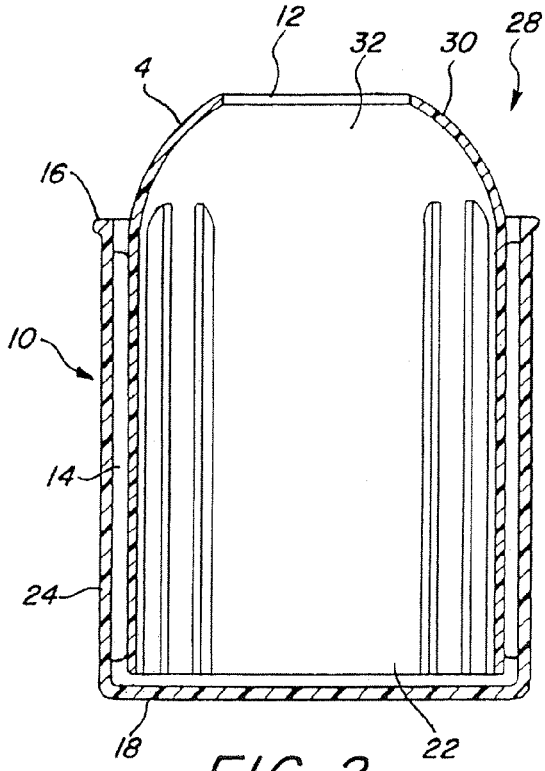
FIG. 2 is a cross-sectional view of FIG. 1 taken along line 2-2.

As shown in FIGS. 1 and 2, a plurality of shims 6 are located on the interior wall 32 of the upper cylindrical enclosure 4. As more clearly shown in FIG. 3, the shims 6 are integral with the interior wall 32 of the upper cylindrical enclosure 4. Each shim is constructed in the form of an open blister. The dimensions of upper cylindrical enclosure 4 and the shims 6 therein are such that a variety of bottle sizes can be accommodated by the upper cylindrical enclosure 4 when it inserts into the lower cylindrical enclosure 10.

Figure 14:
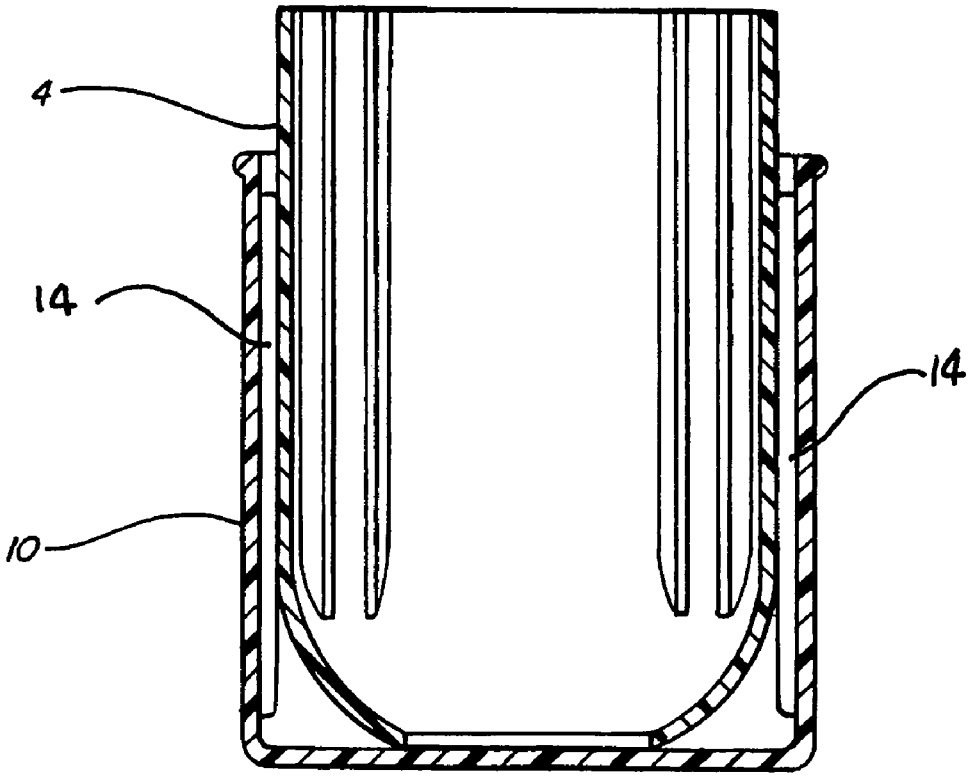
FIG. 14 is a cross-sectional view of the combination bottle and can cooler shown with an upper cylindrical enclosure inverted within a lower cylindrical enclosure.

Also shown in FIGS. 1 and 2, the vertical ribs 14 located on the interior wall 24 of the lower cylindrical enclosure 10 are constructed such that the upper cylindrical enclosure 4 can be inserted into the lower cylindrical enclosure 10 with the second circular rim end 22 of the upper cylindrical enclosure 10 going into the lower cylindrical enclosure 4 first, as shown in FIG. 1, or with the first dome-shaped end 30 of the upper cylindrical enclosure 10 going into the lower cylindrical enclosure 4 first as shown in FIG. 14.

By this construction, the insulating holder 28 can be used to hold the bottle 26 by having the upper cylindrical enclosure 4 inserted into the lower cylindrical enclosure 10 in one direction as seen in FIG. 1 and hold a can by reversing the direction of insertion of the upper cylindrical enclosure 4 into the lower cylindrical enclosure 10 as shown in FIG. 14.

FIG. 2 is a cross-section of FIG. 1 take along a line 2-2. As can be seen, the plurality of vertical ribs 14 are preferably elongated and protrude slightly from an interior wall 24 of the lower cylindrical enclosure 10 such that the upper cylindrical enclosure 4 is snuggly fit into the lower cylindrical enclosure 4. This allows the plurality of vertical ribs 14 to frictionally grip the upper cylindrical enclosure 4. Thus, when the insulating holder 28 is tilted at an angle, upper cylindrical enclosure 10 will remain substantially in place or will exit lower cylindrical enclosure 4 at a reduced speed. This allows a user to drink the contents of the bottle 26 or a can without worrying about the upper cylindrical enclosure 4 and the bottle 26 or can falling out of lower cylindrical enclosure 4.

Figure 3:
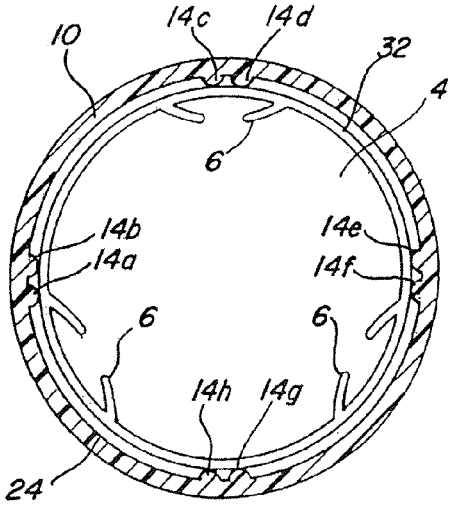
FIG. 3 is a cross-sectional view of FIG. 1 taken along line 3-3.

FIG. 3 is a cross-section of FIG. 1 taken along a line 3-3. As seen in FIG. 3, the vertical ribs 14*a-h* can be arranged in pairs on the interior wall 24 of the lower cylindrical enclosure 10. Each pair of vertical ribs is comprised of a first vertical rib and a second vertical rib such that the distance between the first vertical rib and the second vertical rib can be less than the distance between the first vertical rib and any other plurality of vertical ribs and can also be less than the distance between the second vertical rib and any other plurality of vertical ribs. For example, vertical ribs 14*a* and 14*b*, 14*c* and 14*d*, 14*e* and 14*f*, and 14*g* and 14*h*, form four pairs of vertical ribs. Furthermore, each pair of vertical ribs can be substantially evenly spaced out on the interior wall of the lower cylindrical enclosure 4.

Figure 4:
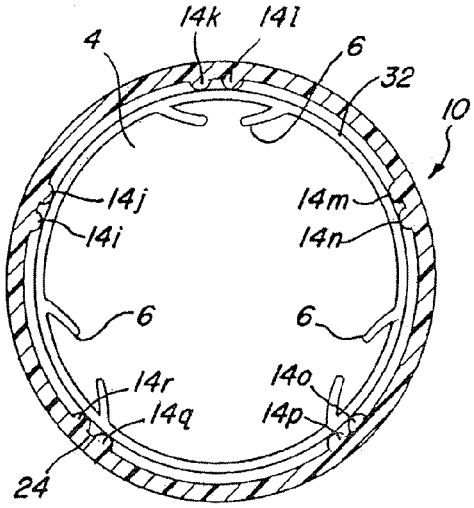
FIG. 4 is a cross-sectional view of an alternate embodiment of the present invention taken along a line 3-3.

FIG. 4 is a cross-section of FIG. 1 taken along a line 3-3 depicting an alternate embodiment. As seen in FIG. 4 the number of vertical ribs can be varied. In FIG. 4, vertical ribs 14*i-r* are arranged in pairs on the interior wall of the lower cylindrical enclosure 4. Like FIG. 3, each pair of vertical ribs is comprised of a first vertical rib and a second vertical rib such that the distance between the first vertical rib and the second vertical rib can be less than the distance between the first vertical rib and any other plurality of vertical ribs and can also be less than the distance between the second vertical rib and any other plurality of vertical ribs. Thus, vertical ribs 14*i* and 14*j*, 14*k* and 14*l*, 14*m* and 14*n*, 14*o* and 14*p*, and 14*q* and 14*r*, form five pairs of vertical ribs. Furthermore, each pair of vertical ribs can be substantially evenly spaced out on the interior wall of the lower cylindrical enclosure 4.

Figure 5:
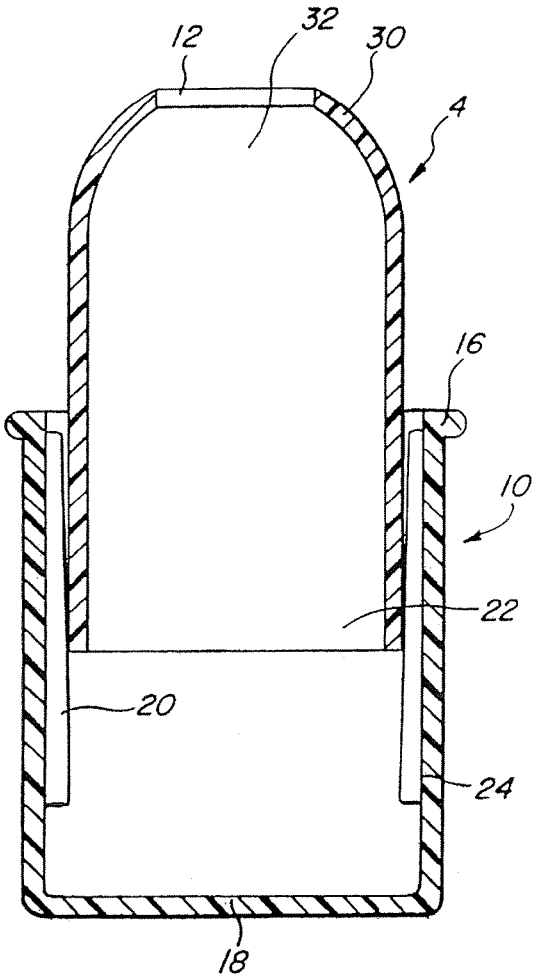
FIG. 5 is a cross-sectional view of FIG. 1 without shims depicting an alternate embodiment of the present invention.
Figure 6:
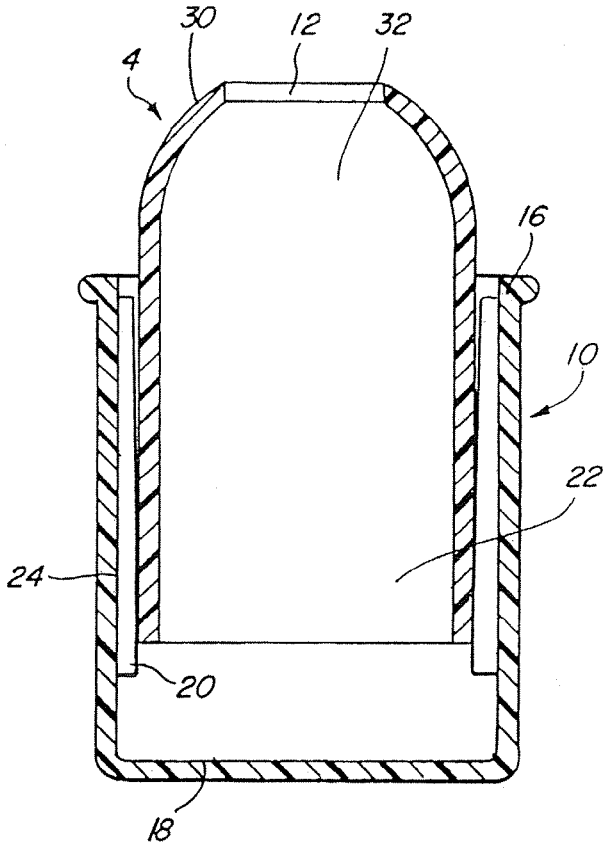
FIG. 6 is a cross-sectional view of FIG. 1 without shims depicting an alternate embodiment of the present invention.

FIGS. 5 and 6 are cross-sectional views of FIG. 1 without shims 6 depicting an alternate embodiment. In FIG. 5 and 6, tapered vertical ribs 20 are tapered such that they are thinner near the top portion 16 of the lower cylindrical enclosure 10 and thicker near the bottom portion 18 of the lower cylindrical enclosure 10. FIGS. 5 and 6 show the upper cylindrical enclosure 4 as it is pushed into lower cylindrical enclosure 10. As can be seen, the further upper cylindrical enclosure 4 is pushed into lower cylindrical enclosure 10, the greater the resistance upper cylindrical enclosure 4 faces from the tapered vertical ribs 20. When pushing the upper cylindrical enclosure 4 all the way into lower cylindrical enclosure 10, the upper cylindrical enclosure 4 may be slightly deformed by the tapered vertical ribs 20 while the tapered vertical ribs 20 maintain a grip on the upper cylindrical enclosure 4. Thus, when the insulating holder 28 is tilted at an angle, upper cylindrical enclosure 10 will remain substantially in place or will exit lower cylindrical enclosure 4 at a reduced speed. This allows a user to drink the contents of the bottle 26 or a can without worrying about the upper cylindrical enclosure 4 and the bottle 26 or can falling out of lower cylindrical enclosure 4.

Figure 7:
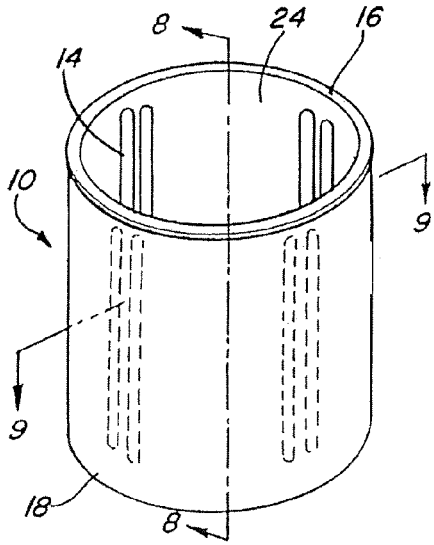
FIG. 7 is a perspective view of the preferred embodiment of the invention showing only the lower cylinder.

FIG. 7 is a perspective view of FIG. 1 without the upper cylindrical enclosure 4. Lower cylindrical enclosure 10 has a plurality of vertical ribs 14.

Figure 8:
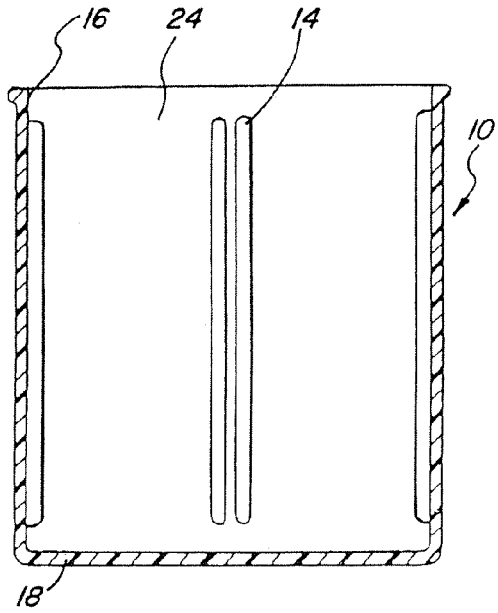
FIG. 8 is a cross-sectional view of FIG. 7 taken along a line 8-8.

FIG. 8 is a cross-section of FIG. 7 taken along a line 8-8. As can be seen in FIG. 8, the plurality of vertical ribs 14 are preferably elongated and protrude slightly from the interior wall 24 of the lower cylindrical enclosure 10.

Figure 9:
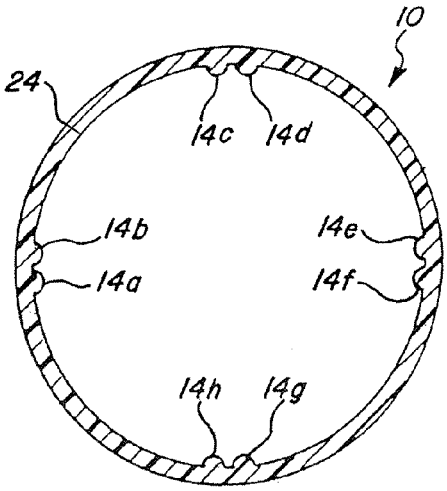
FIG. 9 is a cross-sectional view of FIG. 7 taken along a line 9-9.

FIG. 9 is a cross-section of FIG. 7 taken along a line 9-9. As can be seen in FIG. 9, vertical ribs 14*a-h* form four pairs of vertical ribs along interior wall 24 of the lower cylindrical enclosure 10.

Figure 10:
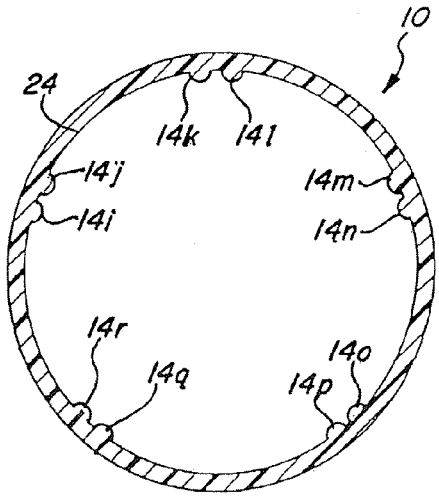
FIG. 10 is a cross-sectional view of FIG. 7 taken along the line 9-9 depicting an alternate embodiment of FIG. 7.

FIG. 10 is a cross-section of FIG. 7 taken along a line 9-9 which depicts an alternate embodiment. As can be seen in FIG. 10, vertical ribs 14*i-r* form five pairs of vertical ribs along interior wall 24 of the lower cylindrical enclosure 10.

Figure 11:
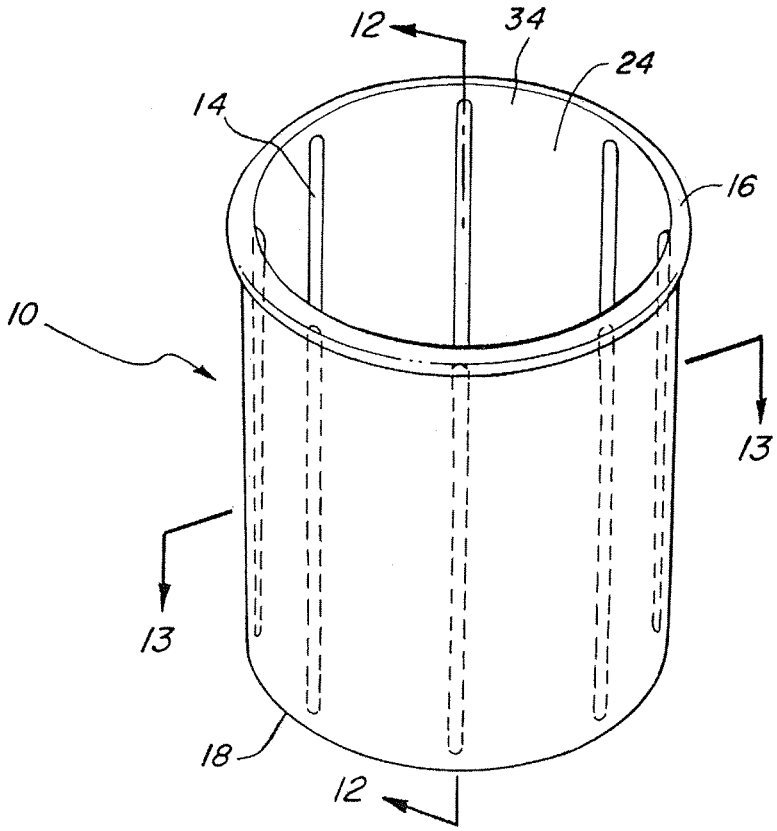
FIG. 11 is a perspective view of an alternate embodiment of the invention.

FIG. 11 is a perspective view of an alternate embodiment of the invention. FIG. 11 has a cylindrical recess 34 in the interior wall 24 around a top portion 16 of the lower cylindrical enclosure 10. The cylindrical recess 34 is configured so that the diameter of the interior wall 24 at the cylindrical recess 34 is greater than the diameter of the interior wall 24 at all other locations of the lower cylindrical enclosure 10. The cylindrical recess 34 is designed to facilitate insertion of an upper cylindrical enclosure 4 into the lower cylindrical enclosure 10 by an unobservant user.

FIG. 11 also depicts the use of 8 vertical ribs substantially evenly spaced along the interior wall of the lower cylindrical enclosure 10. The advantage of having the vertical ribs evenly spaced along the interior wall is that tolerance variations inherent in the manufacturing process for these parts by different manufacturers will not affect the snug fit expected between the upper enclosure 4 and lower enclosure 10.

Figure 12:
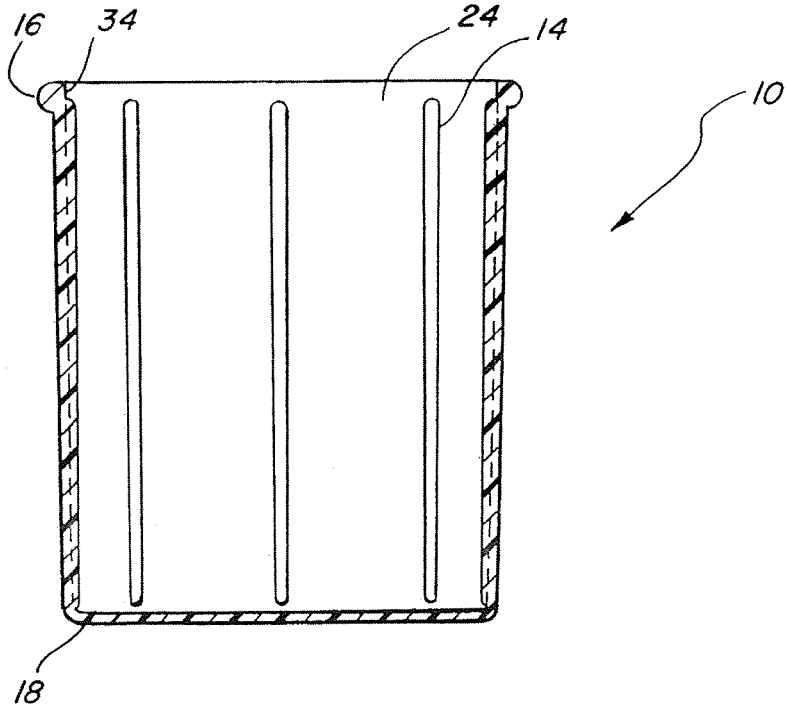
FIG. 12 is a cross-sectional view of FIG. 11 taken along a line 12-12.

FIG. 12 is a cross-section of the lower cylindrical enclosure 10 of FIG. 11, taken along a line 12-12. FIG. 12 more clearly illustrates the cylindrical recess 34 in the interior wall 24 around a top rim 16 of the lower cylindrical enclosure 10.

Figure 13:
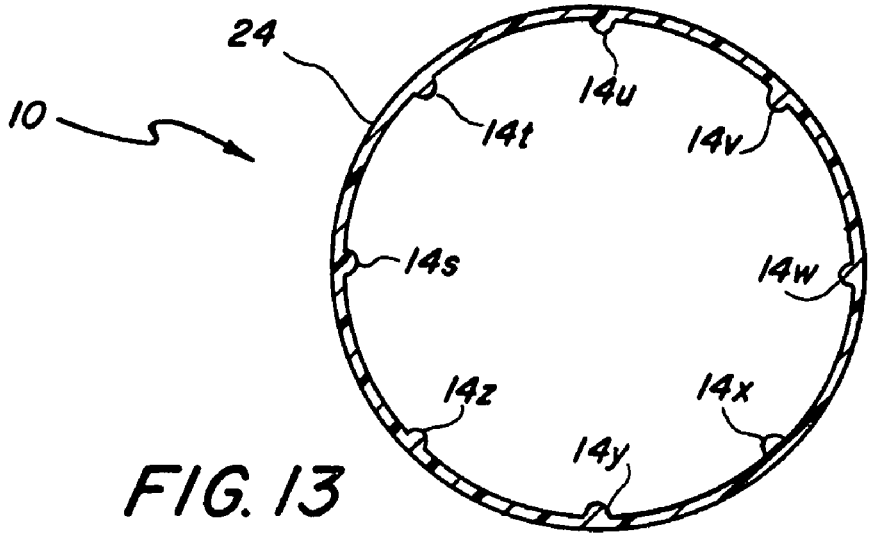
FIG. 13 is a cross-sectional view of FIG. 11 taken along a line 13-13.

FIG. 13 is a cross-section of the lower cylindrical enclosure 10 of FIG. 11, taken along a line 13-13. FIG. 13 more clearly illustrates the 8 vertical ribs 14*z* substantially evenly spaced around the interior wall 24 of the lower cylindrical enclosure 10.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. An insulating holder for holding either a rigid bottle having a top with a neck that increases in diameter down to a shoulder, with a larger diameter bottom half, and a bottom, or for a beverage can having a generally cylindrical diameter with a substantially flat top and bottom, the insulating holder comprising:

a lower cylindrical enclosure formed of insulating material having a closed first end and an open second end defining a cylindrical interior with an interior wall larger in diameter than the bottom half of the rigid bottle, a plurality of vertical ribs arranged around the interior wall of the lower cylindrical enclosure;

an invertible upper cylindrical enclosure formed of insulating material having a dome-shaped first end with a circular opening therein sized to pass the diameter of the bottle neck, and an open second end defining a cylindrical interior with an interior wall, the diameter of the upper cylindrical enclosure being sized to fit within the cylindrical interior of the lower cylindrical enclosure while being in contact with the plurality of vertical ribs on the interior wall of the lower cylindrical enclosure, a plurality of shims arranged around the interior wall of the upper cylindrical enclosure, the shims sized to contact the cylindrical diameter of a beverage can, and pass the bottom half of the bottle;

whereby when the lower cylindrical enclosure contains at least a portion of the bottom half of the bottle, the upper enclosure encloses the bottle from the shoulder down, when the upper enclosure is inserted into the lower enclosure at the upper enclosure open second end, allowing the neck of the bottle to pass through the circular opening in the dome-shaped first end, and when the upper enclosure contains a beverage can, the upper enclosure with the beverage can may be inserted into the lower enclosure second open end, at the upper enclosure dome-shaped first end.

2. The insulating holder of claim 1 wherein one or more of the plurality of vertical ribs around the interior wall of the lower cylindrical enclosure is tapered.

3. The insulating holder of claim 2 wherein there are 8 vertical ribs substantially evenly spaced around the interior wall of the lower cylindrical enclosure.

* * * * *